US005502934A

United States Patent [19]

Coyne et al.

[11] Patent Number: 5,502,934

[45] Date of Patent: Apr. 2, 1996

[54] SKYLIGHT AND/OR ROOF OPENING GUARDRAIL ASSEMBLY

[75] Inventors: Joseph R. Coyne; Patrick D. Coyne; Jack J. Wade, all of Reno, Nev.

[73] Assignee: Lite-Guard Limited Liability Co., Sparks, Nev.

[21] Appl. No.: 259,659

[22] Filed: Jun. 14, 1994

[51] Int. Cl.[6] ..... E04D 13/03

[52] U.S. Cl. ..... 52/200; 49/50; 49/55; 49/57; 49/67; 52/106; 52/202; 52/641; D25/53

[58] Field of Search ..... 49/50, 55, 56, 49/57, 61, 62, 67; 52/106, 200, 202, 640, 641, 643, 646; D25/53

[56] References Cited

U.S. PATENT DOCUMENTS

D. 27,021 5/1897 Smith ..... D25/53 X

D. 354,817 1/1995 Kovacs et al. ..... D25/53

473,128 4/1892 Rankin, Jr. ..... 52/641 X 5,313,748 5/1994 Hughes, Jr. ..... 52/200

OTHER PUBLICATIONS

"Rules and Requirements of the National Board of Fire Underwriters for the Construction and Installation of Skylights as recommended by the National Fire Protection Association"; pp. 11–15; 1908.

Plasteco, Inc.; Fallguard®; Jun. 8, 1994.

Plasteco, Inc.; Fallguard® Skylight Screens; Jun. 8, 1994.

*Primary Examiner*—Carl D. Friedman

*Assistant Examiner*—Kevin D. Wilkens

*Attorney, Agent, or Firm*—Fishman, Dionne & Cantor

[57] ABSTRACT

A skylight or roof opening protective device which comprises a pair of hinged protective frames which pivot outwardly from each other to define an "A" frame, when viewed at either end. Each frame is mounted on a base for temporary or permanent attachment to a skylight or the like.

13 Claims, 2 Drawing Sheets

SKYLIGHT AND/OR ROOF OPENING GUARDRAIL ASSEMBLY

BACKGROUND OF THE INVENTION

This invention relates generally to skylight and/or roof opening safety guard rail devices. More particularly, this invention relates to a skylight or roof opening safety guard rail device that may be installed either temporarily or permanently to prevent a person from inadvertently falling through the skylight or opening.

A NIOSH alert bulletin (DHHS(NIOSH) Publication No. 90–100) issued in December 1989 warned that fatal or debilitating falls may result from failure to provide appropriate guarding and fall protection for work around skylights, skylight openings and other roof openings. NIOSH stands for The National Institute for Occupational Safety and Health which is the group that determines the causes of accidents and illness for the U.S. Department of Health Administration (OSHA) in efforts to prevent worker deaths and injuries on the job or places of employment. This NIOSH alert bulletin was specifically concerned with preventing worker death and injuries from falls through skylights and roof openings. Recent investigations by NIOSH suggest that many fatal falls involve such openings. The bulletin described eight deaths resulting from falls that occurred during work around these openings.

Existing standards of the Occupational Safety and Health Administration (OSHA) regulate the guarding of skylights and other roof openings. Every employer, supervisor and worker in companies where the work may involve exposure to these hazards should comply with these standards.

Occupational fatalities caused by falls remain a serious public health problem throughout the United States. The U.S. Department of Labor lists falls as one of the leading causes of traumatic occupational death, accounting for 8% of all occupational fatalities from trauma (approximately 289 of 3,610 deaths) in 1986. The NIOSH National Traumatic Occupational Fatality (NTOF) data base indicates that during the period 1980–85, falls accounted for nearly 10% (3,491 of 36,210) of all traumatic occupational deaths for which a cause was identified. Of this total, 28 deaths resulted from falls through skylights and 39 deaths resulted from falls through roofs or roof openings. A NIOSH survey in seven States revealed that approximately 22% (14 of 64) of the fatal falls reported to State occupational safety and health officials occurred when workers fell through skylight openings or smoke-vent skylights (translucent plastic domes that serve as both skylights and automatic smoke vents in case of fire). The recent increase in the use of smoke-vent skylights in new construction has increased the exposure of workers to these hazards. Deaths can be prevented by compliance with existing OSHA standards for guarding roof openings and by improvement in the worker's awareness of the hazards involved in working near skylights, skylight openings and other roof openings.

OSHA has promulgated regulations to protect workers from the hazards associated with roof openings (29 CFR 1910 and 1926). The OSHA General Industry Standard requires that "every skylight floor opening and hole shall be guarded by a standard skylight screen or a fixed standard railing on all exposed sides" (29 CFR 1910.23(a)(4)). Requirements for a standard skylight screen are given in 29 CFR 1910.23(e)(8) as follows:

> Skylight screens shall be of such construction and mounting that they are capable of withstanding a load of at least 200 pounds applied perpendicularly at any one area on the screen. They shall also be of such construction and mounting that under ordinary loads or impacts, they will not deflect downward sufficiently to break the glass below them" Code of Federal Regulations.

Although current OSHA standards require employees to guard both skylights and roof openings, these standards were being violated in each case reviewed in the bulletin. Employers and workers may believe that the translucent plastic domes on smoke-vent skylights provide an adequate barrier against falls, but many domes do not. Based on the incidents reported, NIOSH concluded that the increased use of skylights in new construction presents a serious hazard to workers in the construction trades.

NIOSH therefore recommended that the following precautions be taken to prevent fatal falls through skylights, skylight openings and other roof openings:

(1) NIOSH urged that all employers and workers strictly adhere to the applicable OSHA regulations.

(2) Railings guarding all skylights and other openings in roofs must be installed before roofing work begins and must remain in place until construction is completed, in accordance with 29 CFR 1910.23 and 1926.500.

(3) As required by current OSHA standards (29 CFR 1926.28(a)) and consistent with accepted safe work practices, employers must provide protection against falls before workers begin any operations that include the potential for serious falls.

To further emphasize the economical and legal ramifications to an employer based on the foregoing discussion, the following case is representative (as reported in the May 24th 1993 issue of "Employment: Safety and Health Guide, Number 1153, page 7" published by Commercial Clearing House, Inc. as reviewed by the OSHA review commission). The summary of the case is as follows:

"Employees fall through skylight was properly addressed by standard for skylight openings. The failure of a roofing contract to guard a skylight was affirmed as § 1926.500(b)(4) violation in Phoenix Roofing, Inc. (§30.056). An employee died after falling through the skylight to a concrete floor 26 feet below. The Judge found no merit in the employer's contention that the standard's requirement for guarding the "skylight opening" applied only when there was an actual hole. The standard assumes that workers are in danger of falling through a skylight when there is not a standard railing or cover capable of sustaining a 200 pound person.

Although the employer contended that there was no reason for the employee to be near the skylight, access to the hazard by employees in the course of their work activities was reasonably predictable. Phoenix covered skylight openings with plywood only from the time that an old skylight was removed until a new one was installed. Unpreventable employee misconduct was not established, despite the employer's contention that the employee had been drinking before work, because employees were exposed daily to unguarded openings."

There have been some attempts in the prior art of providing a workable solution to the OSHA requirements. An example of such known prior art is exemplified by a product sold under the tradename "Fallguard" as produced by Plasteco, Inc. of Houston, Tex. This prior art device comprises a pre-rolled/formed steel mesh in an arch shape, which is mounted on specially extruded aluminum rails. However, this prior art product has several shortcomings. First, it is made of two components which must be manufactured to special order. In addition, the product can only be permanently installed and therefore cannot be installed temporarily for work on the roof and then removed. Thirdly, should the skylight or roof opening be of any nonstandard dimension, the prior art will not fit correctly. A final major problem is that any emergency roof repair or the fixing of rooftop equipment requires a flexible temporary guardrail assembly which can be installed at a moments notice, as opposed to the permanent guard assembly of the prior art.

Presently, in view of the aforementioned discussion, there is a need for a light weight, easily installed and removed guardrail assembly that has size flexibility to protect skylights and/or roof openings of varying dimensions. In addition, such a device should be capable of installation by one person. Because of the number of skylights or roof openings that may be present in a particular work area, the device should be economical to produce and to purchase.

SUMMARY OF THE INVENTION

The above-discussed and other problems and deficiencies of the prior art are overcome or alleviated by the skylight and/or roof opening guardrail assembly of the present invention. In accordance with the present invention, a low cost, lightweight, flexible skylight and/or roof opening guardrail assembly device is provided which comprises a pair of hinged protective frames which pivot outwardly from each other to define an "A" frame, when viewed at either end. More particularly, the device of this invention comprises two base rails, a multiplicity of angular upright risers, a top ridge longitudinal member, a multiplicity of guard rails, a multiplicity of hinges affixed to the base rails, safety chains and adjustable chains. One half of the guard rail assembly is folded against the second half of the guard rail assembly when not in use.

The guardrail assembly is installed over a skylight and/or roof opening by pulling the two halves away from each other so that the two base rails line up with and fit over the two longitudinal sides of the skylight or roof opening. Of course, if the roof opening is square, it could fit over any two opposing sides of the skylight or roof opening.

The two base rails have a multiplicity of holes that are used to fasten the guardrail assembly to the frame of the skylight as necessary. Alternatively, the guardrail assembly is attached to the roof opening framing to provide protection. An alternative embodiment of the present invention accommodates square skylights or roof openings.

The above-discussed and other features and advantages of the present invention will be appreciated and understood by those of ordinary skill in the art from the following detailed discussion and drawings:

DESCRIPTION OF THE PREFERRED EMBODIMENT

Figure 1:
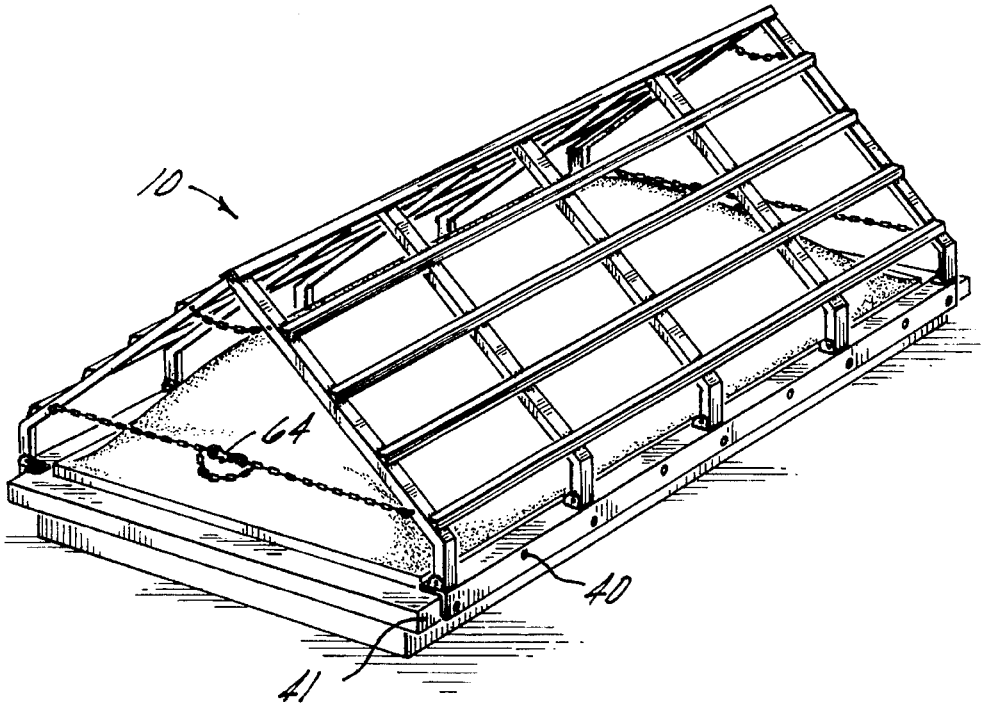
FIG. 1 is a perspective view of a skylight and/or roof opening guardrail assembly in accordance with the present invention.
Figure 2:
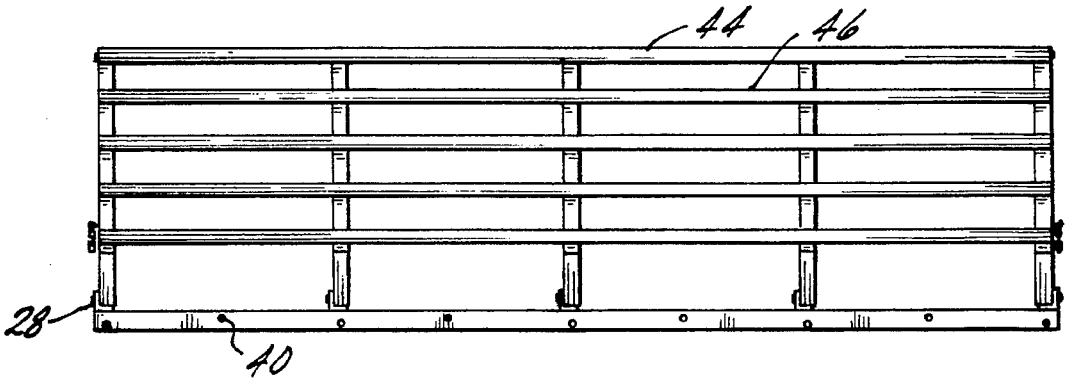
FIG. 2 is a side elevation view of the device of FIG. 1.
Figure 3:
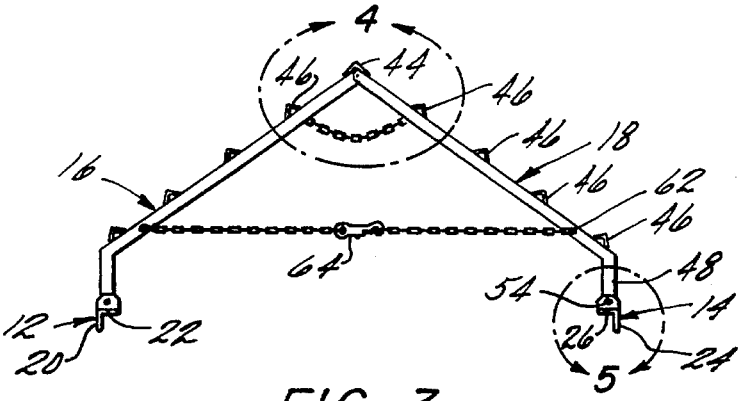
FIG. 3 is an end elevation view of the device of FIG. 1.
Figure 4:
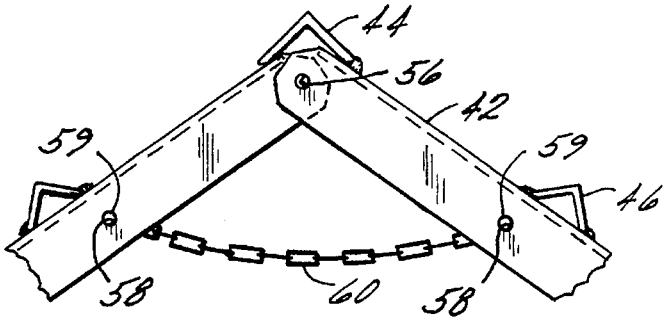
FIG. 4 is an exploded detail view along the circle line 4 of FIG. 3.
Figure 5:
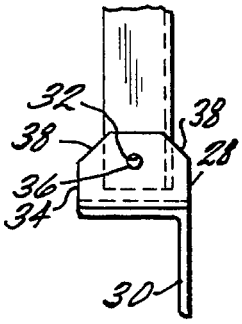
FIG. 5 is an exploded detail view along the circle line 5 of FIG. 3.

Referring first to FIG. 1, the skylight and/or roof opening guardrail assembly of the present invention is shown generally at 10. Referring now to FIGS. 1–5, device 10 is comprised of four main subassemblies; a left base rail assembly 12, a right base rail assembly 14; a left guardrail assembly 16; and a right guardrail assembly 18 (see FIG. 3).

Base rail assemblies 12 and 14 are assembled from two separate components. Each base rail assembly consists of a multiplicity of hinges 28 and a base rail 30. The hinges 28 are "L" shaped (see FIG. 2 and FIG. 5) with a hole 32 near the top of the vertical leg 34 of hinge 28 to receive a fastener 36 which will join assembly 16 to assembly 12 and assembly 18 to assembly 14. The hinges 28 are joined to base rail 30 by welding or other known means. It should be noted that the vertical leg 34 is chamfered or rounded to avoid sharp edges. These chamfers 38 are achieved by known methods. In addition, base rail 30 has a multiplicity of staggered holes 40 to allow attachment of device 10 to a suitable base such as a frame of a skylight and/or roof opening (for example, a skylight frame is shown at 41 in FIG. 1 ). The holes 40 are of a known standard size.

Left base rail assembly 12 and right base rail assembly 14 are identical except outside leg 20 of angle member 22 is on the left side of base rail assembly 12 and the outside leg 24 of angle member 26 is on the right side of base rail assembly 14 when the device 10 is completely assembled and installed in place over a skylight or roof opening. In other words, left base rail assembly 12 and right base rail assembly 14 are identical except for their orientation when assembled together with left guard assembly 16 and right guardrail assembly 18.

Right guardrail assembly 18 (see FIGS. 1–4) is comprised of three components, a multiplicity of spaced, angular upright risers 42, a top ridge guardrail 44, and a multiplicity of spaced guardrails 46 (e.g., cross-members). The top ridge guardrail 44 and guardrails 46 are preferably oriented at 90 degrees with respect to risers 42. The angular upright riser 42 has a short leg 48, an inclusive angle or bend 50 and a long leg 52. Short leg 48 should be of sufficient length to be sure that angle 50 is well above any skylight bubble or protrusion. Long leg 52 should be of a suitable length so that upright riser 42 ends up at the midpoint of the skylight or roof opening. A hole 54 near the end of short leg 48 is fabricated by known methods to match up with hole 32 of hinge 28. Near the end of long leg 52, a hole 56 is made to mate up with a second hole 56 when the two assemblies 18 and 16 are fastened together in the middle of device 10 (fasteners not shown). About one third of the way from hole 56 on long leg 52, another hole 58 is provided for mating with a fastener 59 to anchor one end of a safety chain 60. At the other end of long leg 52 near angle 50, another hole 62 is provided to anchor one end of an adjustable chain 64 (see FIG. 3). The adjustable chain 64 permits quick and easy adjusting of the distance between base rail assemblies 12 and 14 (e.g., chain 69 adjusts the angle in the "A" frame defined by the left and right guardrail assemblies). A safety chain 60 precludes the opposed frame members from pivoting out of contact with the skylight or roof opening.

Top ridge guardrail 44 is welded or otherwise fastened to the ends of the multiplicity of angular upright risers 42 so that holes 56 match up together. The multiplicity of guardrails 46 are then welded or otherwise fastened to the multiplicity of angular upright risers 42 to complete the fabrication of right guardrail assembly 18.

Left guardrail assembly 16 is fabricated in the same manner as right guardrail assembly 18 as discussed above except that these are only two components, a multiplicity of angular upright risers 42 and a multiplicity of guardrails 46. There is only one top ridge guardrail 44 which has already been made part of right guardrail assembly 18. It will be appreciated that top ridge 44 is not attached to left guardrail assembly 16 (although it may be in contact therewith) so as to allow the left and right guardrail assemblies to fold inwardly as shown in FIG. 7.

Figure 6:
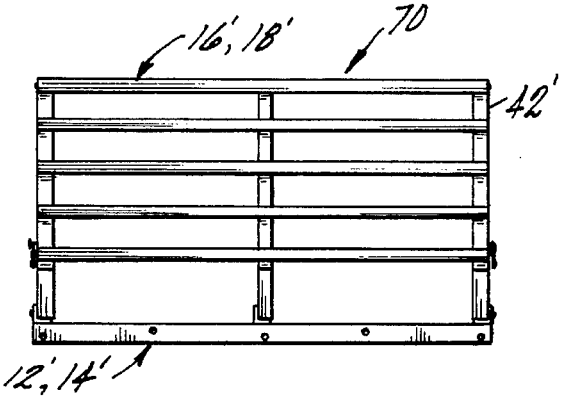
FIG. 6 is a side elevation view of an alternative embodiment of the device of FIG. 1.

Referring now to FIG. 6, an alternative embodiment of the present invention is shown generally at 70. Device 70 is in all respects similar to device 10. Angular upright risers 42' are the same dimensionally as those in the preferred embodiment. Base rail assemblies 12' and 14', right guardrail assembly 18' and left guardrail assembly 16' are fabricated in the same manner and are similar (except dimensionally in the longitudinal direction when compared to base rail assemblies 12, 14 and guardrail assemblies 18, 16 of the preferred embodiment of FIG. 1 ). Note that because of the shortened length of the device of FIG. 6, not as many annular upright risers are required. Of course, the FIG. 6 embodiment is useful for smaller, square skylights (or roof openings) relative to the larger embodiment of FIG. 1. In any event, it will be appreciated that the protective device of this invention may be manufactured to removably attach to any standard (or non-standard) skylight or roof opening.

Figure 7:
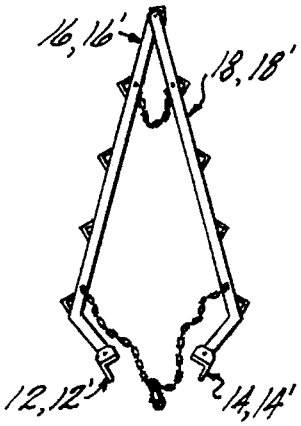
FIG. 7 is a folded end elevation view of the device of FIG. 1 or of FIG. 6.

In FIG. 7, which is a folded end view of the device 10 of FIG. 1 or the device 70 of FIG. 6, it will be appreciated that the left guardrail assembly 16, 16' easily folds together toward the right guardrail assembly 18, 18'. Further note that left base rail assembly 12, 12' and right based rail assembly 14, 14' are free to pivot at the end of angular upright risers 42, 42' allowing free adjustment for any size skylights or roof openings.

EXAMPLE

Referring back to the preferred embodiment of FIGS. 1–5, a typical bill of material would include the following. All materials are standard structural angle (e.g., having a "L" shaped cross-section), preferably made of lightweight, aluminum material. The angular upright riser 42 would preferably be 10 in number, 38" long; each having a "L" shape cross-section preferably 1¼"×1¼"×⅛". The angle or bend 50 between the short leg 38 and the long leg 52 should be preferably 75 degrees. The top ridge guardrail 44 would preferably be 100" long ×1¼"×1¼×1¼×⅛". The base rails 30 would preferably be 101" long×2"×2"×⅛" and two in quantity. Preferably the hinges 28 are 2" long ×1¼"×⅛" and 10 in number. Finally it is preferred to have ten guardrails that are each 100" long× ¾"×¾"×⅛". Fasteners for the base rails are preferably 15 in number and should be size 15¼"×1 cap screws; 45¼"0 flat washers; 30 ¼" hex nuts; 2 ½" snap opens for fast adjusting to bolt or rivet the rivotable portions. The hinges 28 and the angular upright risers 42 should be rounded or chamfered to prevent cuts or scrapes in handling of the assembled device 10. The safety chain 60 and adjustable chain 64 should be made of 2/0 coil straight link chain material and should be preferably of 2/0 coil straight link chain size and further incorporate 2½" snap-opens for bottom chain adjustment.

The protective device of this Example meets all applicable standards required by OSHA including the ability to withstand a load of at least 200 pounds applied perpendicularly at any one area on either the left or right frames.

It should be noted that there are other materials that would be suitable to fabricate the present invention, the foregoing being merely by example only. Further it is preferred that suitable erosion resistant methods and materials be used.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A protective device for skylights, roof openings and the like comprising;

a first frame having a top and bottom;

a second frame having a top and bottom, said top of said first frame being pivotably attached to said top of said second frame:

a first support base connected to the bottom of said first frame and a second support base connected to bottom of said second frame, each of said support bases including means for supporting said respective first and second frames on a sky light, roof opening or the like; and connecting means attached between said first and second frames for retaining said first and second frames at a desired angular orientation when said first and second frames are pivoted between a closed position and an open position and wherein said first and second frames have an "A" shape when viewed at either end in said open position.

2. The device of claim 1 wherein each of said first and second frames comprise:

a plurality of spaced risers; and a plurality of spaced cross-members attached to said risers at about 90 degrees with respect to said risers.

3. The device of claim 2 wherein:

said risers and said cross-members each have an "L" shaped cross-section.

4. The device of claim 2 wherein each of said risers include:

a short section and a longer section extending at an inclusive angle from said short section, said short section being connected to said one of said first and second support bases.

5. The device of claim 4 wherein:

said cross-members are attached to said longer sections of said risers.

6. The device of claim 2 including:

a top longitudinal ridge which is permanently connected to only one of said tops of said first and second frames.

7. The device of claim 1 wherein:

said first and second support bases have a "L" shaped cross-section.

8. The device of claim 1 wherein:

said first and second support bases are pivotably connected to said respective first and second frames.

9. The device of claim 1 wherein said connecting means comprises:

at least one chain.

10. The device of claim 9 wherein:

said chain includes means for adjusting the length thereof.

11. The device of claim 1 wherein said connecting means comprises:

at least one safety chain; and at least one adjustable chain spaced from said safety chain.

12. A protective device for skylights, roof openings and the like comprising:

a first frame having a top and bottom;

a second frame having a top and bottom, said top of said first frame being attached to said top of said second frame;

a first support base connected to the bottom of said first frame and a second support base connected to bottom of said second frame, each of said support bases including means for supporting said respective first and second frames on a sky light, roof opeing or the like; and connecting means attached between said first and second frame for retaining said first and second frames at a desired angular orientation and wherein said first and second frames have an "A" shape when viewed at either end.

13. A protective device for skylights, roof openings and the like comprising;

a first frame having a top and bottom;

a second frame having a top and bottom, said top of said first frame being pivotably attached to said top of said second frame:

a first support base connected to the bottom of said first frame and a second support base connected to bottom of said second frame, each of said support bases including means for supporting said respective first and second frames on a sky light, roof opening or the like; and a plurality of spaced risers; and a plurality of spaced cross-members rigidly attached to said risers at about 90 degrees with respect to said risers; and connectors attached between said first and second frames for retaining said first and second frames at a desired angular orientation when said first and second frames are pivoted between a closed position and an open position and wherein said first and second frames have an "A" shape when viewed at either end in said open position.

* * * * *